US006910312B2

(12) United States Patent
Whitworth

(10) Patent No.: US 6,910,312 B2
(45) Date of Patent: Jun. 28, 2005

(54) STORM BRACE ASSEMBLY

(76) Inventor: Breck Whitworth, 15434 Vick Rd., Gulfport, MS (US) 39503

( * ) Notice: Subject to any disclaimer, the term of this patent is extended or adjusted under 35 U.S.C. 154(b) by 0 days.

(21) Appl. No.: 10/622,745

(22) Filed: Jul. 21, 2003

(65) Prior Publication Data

US 2005/0016092 A1 Jan. 27, 2005

(51) Int. Cl.[7] ..... E06B 3/26
(52) U.S. Cl. ..... 52/741.3; 52/202; 52/127.2
(58) Field of Search ..... 52/202, 203, DIG. 12, 52/127.1, 127.2, 741.3; 248/200.1

(56) References Cited

U.S. PATENT DOCUMENTS 446,480 A * 2/1891 Stebbins ..... 160/81
704,403 A * 7/1902 Thill ..... 248/200.1
840,770 A 1/1907 Ives
1,256,849 A * 2/1918 Vaudreuil ..... 211/123
1,681,010 A 8/1928 Raggio
2,794,217 A * 6/1957 Croft ..... 248/200.1
3,027,140 A * 3/1962 Holzbach ..... 254/98
4,085,788 A * 4/1978 Bernardo ..... 160/133
4,118,911 A * 10/1978 Lewchuk ..... 52/749.1
4,449,876 A * 5/1984 Glanton ..... 410/151
4,452,020 A * 6/1984 Werner ..... 52/202
4,633,612 A * 1/1987 Forkish ..... 49/55
5,335,452 A 8/1994 Taylor
5,507,118 A 4/1996 Brown
5,590,863 A 1/1997 Sasaki
5,673,883 A 10/1997 Figueroa, Jr.
5,937,593 A * 8/1999 White ..... 52/106
6,219,978 B1 4/2001 Wood
6,233,877 B1 5/2001 Monroe
6,330,768 B1 12/2001 Rodrigues
6,363,670 B1 4/2002 Dewitt
6,371,422 B1 4/2002 St. Martin et al.
6,408,592 B1 6/2002 Hourani

* cited by examiner

*Primary Examiner*—Brian E. Glessner
*Assistant Examiner*—Basil Katcheves
(74) *Attorney, Agent, or Firm*—Diederiks & Whitelaw, PLC

(57) ABSTRACT

A brace assembly is provided to hold a panel against a windowed building component to prevent property damage during a severe storm. The brace assembly includes a bar having a first end portion and a second end portion, wherein the first end portion includes a plate having a threaded hole therein. The brace assembly further includes a threaded rod that is fastened to the threaded hole at one end and includes a foot plate at a second end. A turn handle extends through the threaded rod for facilitating rotation of the threaded rod. When the brace assembly is placed against a panel extending across a windowed building component, rotation of the threaded rod forces the foot plate and bar against opposing frame walls, thereby holding the panel in place.

20 Claims, 3 Drawing Sheets

STORM BRACE ASSEMBLY

BACKGROUND OF THE INVENTION

1. Field of the Invention

The present invention pertains to a method and apparatus for protecting windows, glass doors, and the like from damage during severe storms, such as hurricanes.

2. Discussion of the Prior Art

Large panels of plywood or similar rigid materials have long been used to protect windows and glass doors from damage resulting from severe storms, such as hurricanes. The panels are typically attached to the area surrounding the windows or doors with nails or screws, thereby permanently damaging the building. In addition, it is very time consuming to secure and later remove plywood over doors and windows using traditional methods involving nails or screws.

In attempts to solve problems associated with securing buildings for an imminent storm, some devices have been developed to secure plywood panels without damaging the surrounding building structure. For example, U.S. Pat. Nos. 5,673,883, 6,330,768 and 6,371,422 all describe methods of retaining plywood boards over windows with bars for the sake of protecting the windows from storms without damaging the surrounding window frames. However, none of these patents discloses a brace assembly for securing a panel across a window, glass door, or the like, wherein the brace assembly that can be quickly installed and may be easily used for a variety of different sized windows and doors. To this end, there still exists a need in the art for a method and apparatus for quickly and easily protecting windows, glass doors and the like against storm damage.

SUMMARY OF THE INVENTION

The present invention is directed to a method and apparatus for holding a panel across a windowed building component, such as a building window, glass door, windowed garage door, or the like, arranged within opposing frame walls in order to prevent undue property damage during a severe storm. In accordance with the invention, a brace assembly is employed which includes a bar having a first end portion and a second end portion, wherein the first end portion is provided with a plate having a threaded hole formed therein. The brace assembly also includes a threaded rod that is fastened to the threaded hole at one end and includes a foot plate at a second end. A turn handle extends through the threaded rod adjacent the second end for facilitating rotation of the threaded rod.

In use, the brace assembly is placed in front of and across a panel covering a windowed building member, whether in the form of a window, a glass door, or the like. Thereafter, rotation of the threaded rod forces the foot plate and second end portion of the bar against the opposing walls of the frame, thereby holding the panel in a position which protects the windowed building member. In accordance with the invention, the bar can take various forms which provide for varying degrees of extension. More specifically, the bar can be formed of a single member or multiple, interconnected members. For larger windowed building members, provisions are made for employing one or more brace assemblies to retain multiple panels which are joined by a connecting strip.

Additional objects, features and advantages of the present invention will become more readily apparent from the following detailed description of preferred embodiments, when taken in conjunction with the drawings wherein like reference numerals refer to corresponding parts in the several views.

DETAILED DESCRIPTION OF THE PREFERRED EMBODIMENTS

Figure 2:
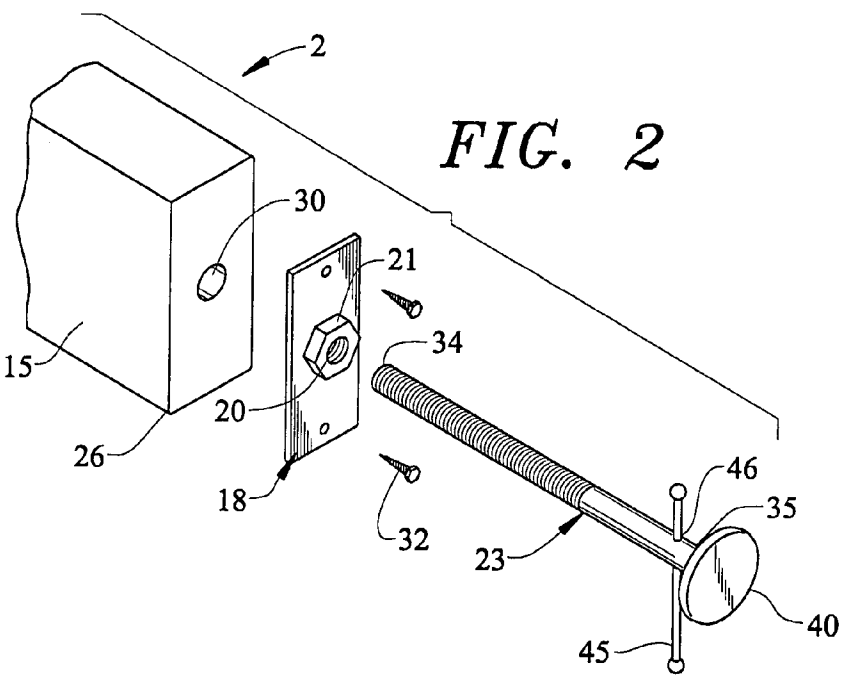
FIG. 2 is an exploded view of an end portion of the brace assembly shown in FIG. 1.
Figure 1:
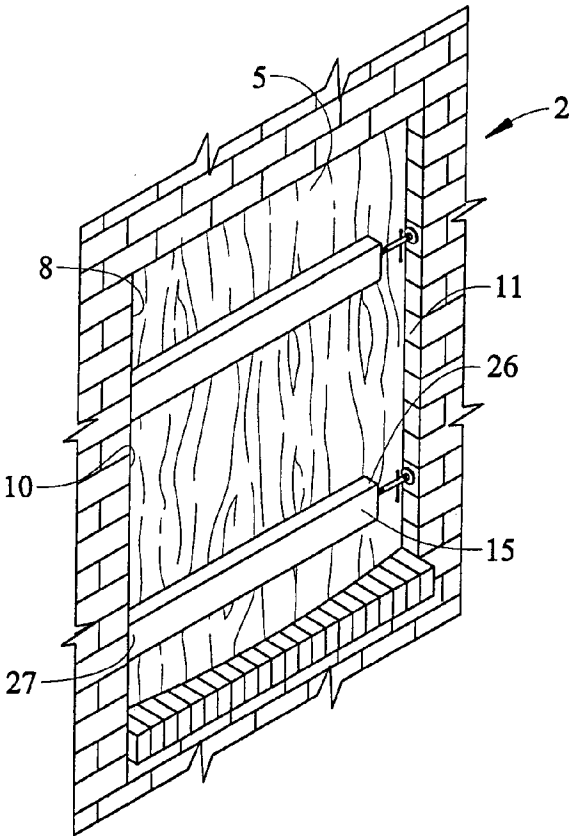
FIG. 1 is a partial perspective view of a brace assembly constructed in accordance with a first embodiment, with the brace assembly being shown securing a panel within a window frame of a building.

With initial reference to FIG. 1, a brace assembly constructed in accordance with the present invention is generally indicated at 2. In general, brace assembly 2 is used to retain a protective panel 5, such as a sheet of plywood, within a window or other building opening 8, defined by opposing frame walls 10 and 11, in preparation for a severe storm. In accordance with a first embodiment of the invention as shown in FIGS. 1 and 2, brace assembly 2 includes a bar 15, a metal end plate 18 having a threaded hole 20 defined by an integrated nut member 21, and a threaded rod 23. Bar 15, which may be formed of wood, plastic, metal, fiberglass, or the like, has a first end portion 26 and a second end portion 27. In general, bar 15 has a length such that, when placed horizontally between opposing frame walls 10 and 11 of opening 8, enough space is left as to allow for side to side movement of bar 15 as discussed further below. First end portion 26 of bar 15 includes a bore 30 which is drilled or otherwise formed in bar 15 to allow threaded rod 23 to enter bar 15, as will also be discussed in detail below.

End plate 18 is placed over first end portion 26 of bar 15 and positioned so that threaded hole 20 of end plate 18 is aligned with bore 30 formed in bar 15. End plate 18 may be attached to bar 15 with nails, screws, or any other securing means. Threaded rod 23 includes a first threaded end 34, which is screwed into threaded hole 20, and a second end 35, which includes a foot plate 40 that can spin freely relative to second end 35. Threaded rod 23 also includes a turn handle 45 designed to allow a user to easily rotate threaded rod 23. More specifically, second end 35 includes a cross bore 46 through which handle 45 extends such that handle 45 extends substantially perpendicular to a longitudinal axis of rod 23, while preferably being slidable relative to rod 23.

Brace assembly 2 is preferably assembled and sized to fit within opening 8 prior to a storm. More specifically, bar 15 is cut to a length about 3–6 inches (approximately 7.5–15 cm) less than the distance between opposing frame walls 10 and 11. End plate 18 is then securely attached to bar 15 and threaded rod 23 is screwed into threaded hole 20 until the combined length of bar 15 and a protruding portion of threaded rod 23 is slightly less than the distance between opposing walls 10 and 11 of opening 8. That is, when a storm is determined to be approaching, a building component, which is not shown in FIG. 1 but includes either a window, glass door, or the like, may be covered by panel 5. Brace assembly 2 is then positioned between opposing walls 10 and 11 of opening 8 and against panel 5 as shown in FIG. 1. Rotation of threaded rod 23 through turn handle 45 extends the overall length of brace assembly 2 and secures brace assembly 2 across opening 8. More specifically, rotation of turn handle 45 in a specified direction causes threaded rod 23 to move in a direction away from bar 15, thereby forcing foot plate 40 and second end 27 of bar 15 against opposing walls 10 and 11. By securing brace assembly 2, panel 5 is held firmly in place to protect the window, glass door or other glass containing building component (not shown) arranged behind panel 5 from damage.

Figure 3:
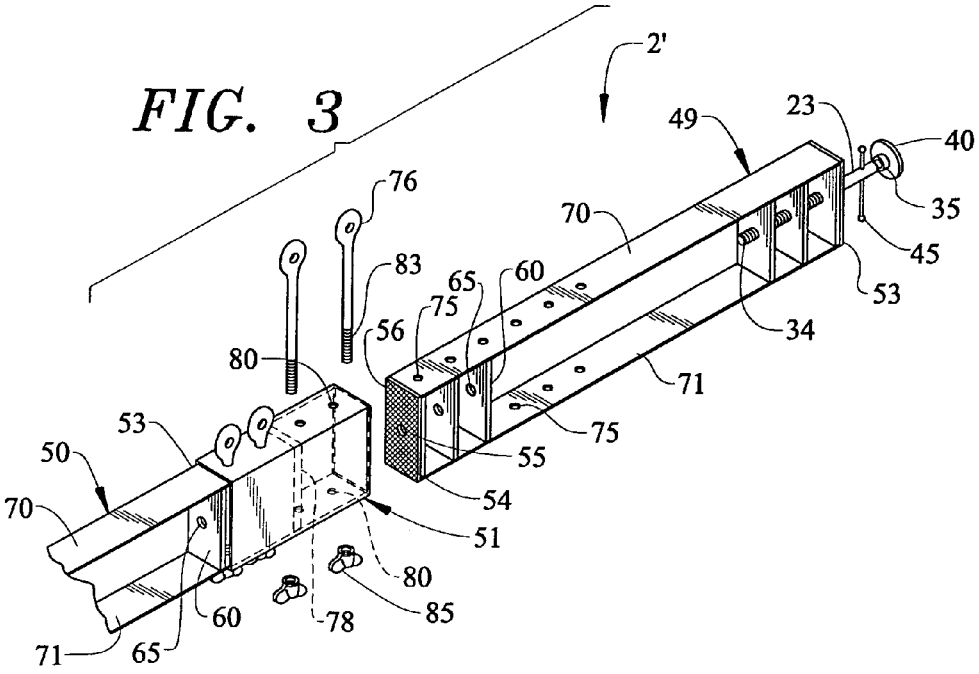
FIG. 3 is an exploded view of a modified form of the brace assembly of the present invention.

In some situations it may be desirable to have a brace assembly that can be extended to cover larger openings. Such an extended brace assembly is considered to be particularly useful in connection with commercial windows or other long spanning windows or glass doors. As shown in FIG. 3, a brace assembly 2' includes two bars 49 and 50 that are joined together with a connector 51. Each of bars 49 and 50 are preferably metal, generally open and identically constructed. That is, each bar 49, 50 includes a first end portion 53 and a second end portion 54, with both end portions 53 and 54 having threaded apertures 55 formed therein and rubber gripping pads 56 thereon. Each of bars 49 and 50 also includes a plurality of longitudinally spaced, internal plates 60, each of which has a threaded hole 65 formed therein that is aligned with apertures 55 formed in end portions 53 and 54. With this arrangement, each bar 49, 50 is reversible. In addition, each of bars 49 and 50 includes a top plate member 70 and a bottom plate member 71, with both plate members 70 and 71 having various sets of aligned apertures 75 for receiving locking pins 76, as will be discussed in detail below.

Connector 51 is open-ended to allow for easy insertion of bars 49 and 50. A plate 78 is located within connector 51 to establish a permissible degree of insertion for each of bars 49 and 50. Connector 51 also has apertures 80 formed therein which align with respective apertures 75 formed in bars 49 and 50. When apertures 80 are aligned with apertures 75, locking pins 76 may be inserted in order to attach bars 49 and 50 to connector 51, as clearly shown in FIG. 3. In the preferred embodiment shown, each locking pin 76 includes a threaded portion 83 to which a fastener 85 is secured. More specifically, bars 49 and 50 are secured to connector 51 through the use of locking pins 76 and fasteners 85.

When bars 49 and 50 are secured to connector 51, threaded rod 23 may be screwed into one of apertures 55, along with a threaded hole 65, until the combined length of bars 49 and 50, along with a protruding portion of threaded rod 23, is slightly less than the distance between opposing walls of a windowed opening (not shown for this embodiment). After positioning brace assembly 2' in between opposing walls of the opening, rotation of threaded rod 23 secures brace assembly 2' across the opening in a manner directly corresponding to that described above with reference to brace assembly 2.

Figure 4:
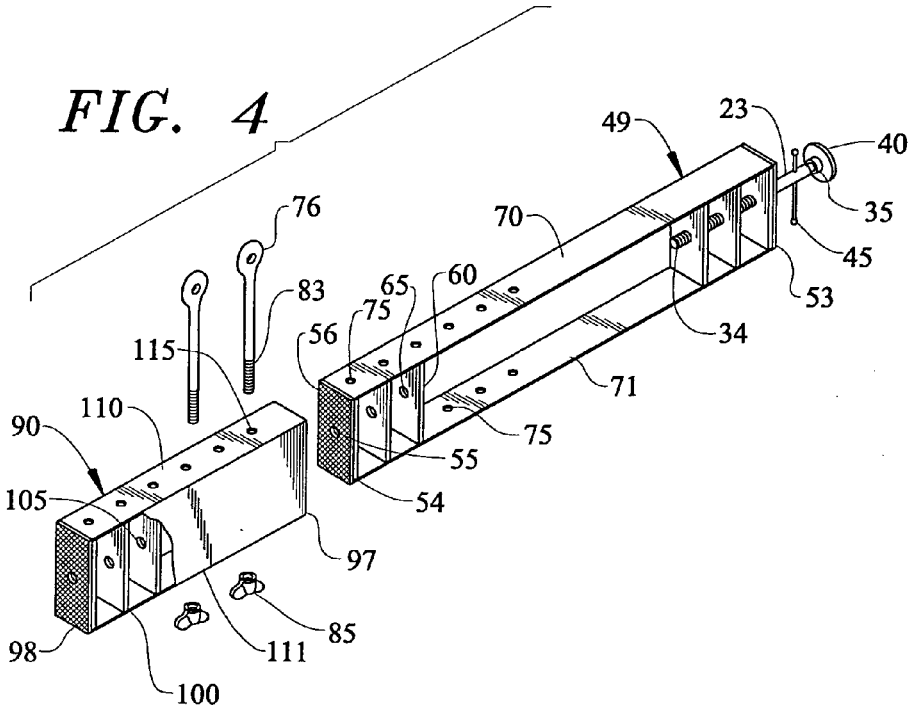
FIG. 4 is an exploded view of a third embodiment of the brace assembly.

As shown in FIG. 4, either or both of bars 49 and 50 of brace assembly 2' may be adapted to be of an intermediate adjustable length. For example, if an opening 8 is too small to accommodate both bars 49 and 50, one of bars 49, 50 can be used in connection with an extension bar 90. Extension bar 90 is hollow and has a first end portion 97 and a second end portion 98. First end portion 97 is open to allow second end portion 54 of bar 49 to slide into extension bar 90. Similar to bar 49, extension bar 80 includes a plurality of longitudinally spaced, internal plates 100, each of which preferably has a threaded hole 105 formed therein. In addition, extension bar 90 has a top plate 110 and a bottom plate 111, with both plates 110 and 111 having apertures 115 for receiving locking pins 76, as will be discussed below.

When apertures 75 in bar 49 are aligned with apertures 115 in extension bar 90, locking pins 76 may be inserted in order to attach bars 49 and 90 together in a manner directly corresponding to that described above. After bar 49 is inserted into extension bar 90, the combined length of bars 49 and 50 may be adjusted by moving bar 49 towards or away from extension bar 90 until the combined length of bars 49 and 90 reaches the desired size. Locking pins 76 may then be inserted to hold bars 49 and 90 in position. Given the corresponding structure between bars 49 and 90, rod 23 can be employed at either end, or two rods 23 could actually be utilized which is also true in the first embodiment described above.

Figure 5:
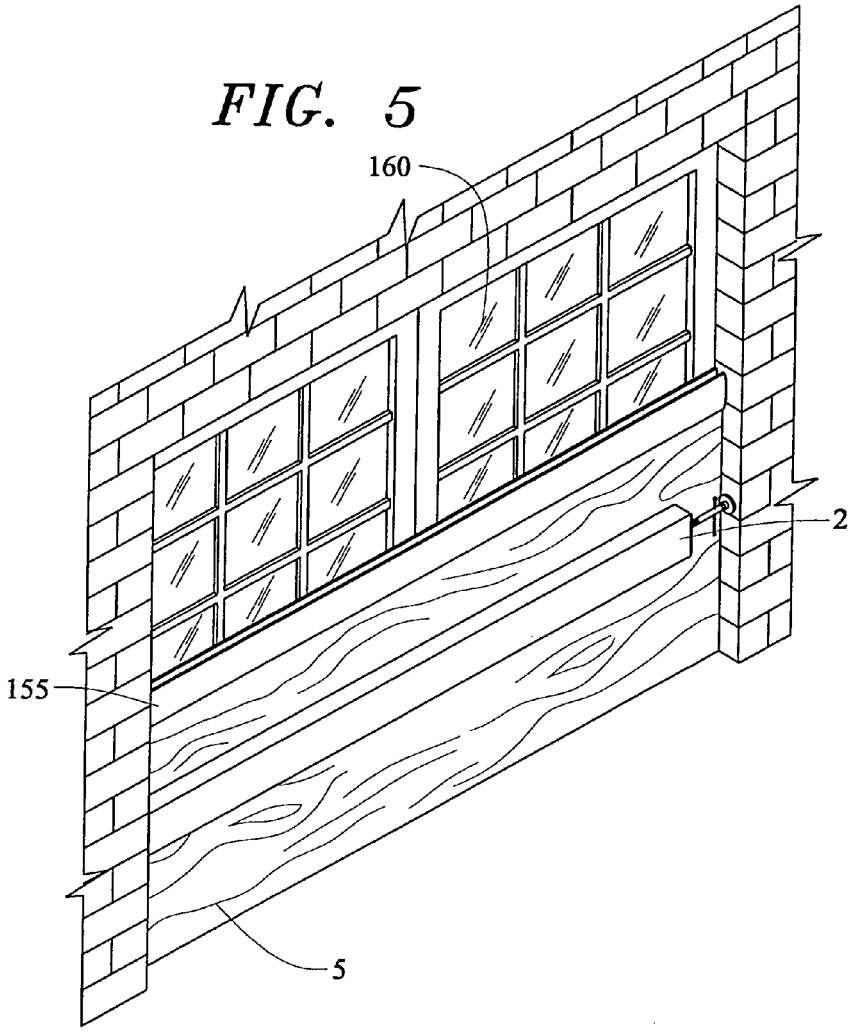
FIG. 5 is a perspective view of the brace assembly of FIG. 1 used in combination with a panel connecting strip for securing two protection panels together.
Figure 6:
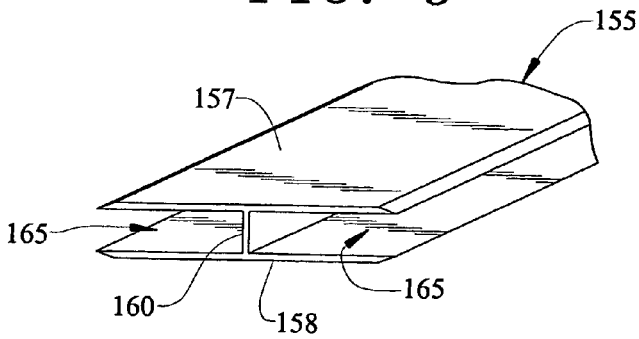
FIG. 6 is a partial perspective view of the panel connection strip shown in FIG. 5.

As shown in FIGS. 5 and 6, an H-strip 155 may be used to secure two panels, one of which is indicated at 5 in FIG. 5, together to cover large building components, such as glass French doors or a set of directly adjacent windows 160. H-strip 155 may be formed of plastic, metal or any other suitable material, and includes spaced walls 157 and 158 which are separated by a cross piece 160 so as to define opposing grooves or channels 165 and 166 for receiving a pair of panels 5. As shown in FIG. 7, panel 5 may be inserted into groove 165 and secured by a brace assembly 2, 2', etc. A second panel (not shown) may then be inserted into groove 166 to cover the upper portion of windows 160. Thereafter, a second brace assembly (not shown) may be used to secure the second panel in place.

Based on the above description, it should be readily apparent that employing the brace assembly of the present invention provides for a strong and easily assembled protection system for a wide variety of windowed building components. Although described with reference to preferred embodiments of the invention, it should be readily understood that various changes and/or modifications can be made to the invention without departing from the spirit thereof. For instance, the size and shape of the various components can be readily varied. For example, foot plate 40 could be made rectangular and even provided with a rubber pad for enhanced gripping purposes. In addition, although the brace assembly of the invention has been shown and described as being mounted substantially horizontally in a building opening, it should be realized that substantially vertical or even angled mounting arrangements could be employed. In general, the invention is only intended to be limited by the scope of the following claims.

I claim:

1. A brace assembly for securing a panel across a windowed building component located between opposing frame walls in order to protect the windowed building component during a storm comprising:

a bar having a first end portion and a second end portion;

a plurality of spaced apart plates fixed at the first end portion of the bar, each of said plates including a threaded hole; and a threaded rod having a first end and a second end, said first end being adjustably, threadably connected to the bar through the threaded holes and said second end including a foot plate, wherein said brace assembly is adapted to be positioned against a panel positioned across a windowed building component with rotation of the threaded rod forcing the foot plate and second end portion of the bar against the opposing frame walls, thereby securing the panel in a protective posture across the windowed building component.

2. The brace assembly according to claim 1, further comprising:

a handle member provided at the second end portion of the threaded rod for facilitating rotation of the threaded rod.

3. The brace assembly according to claim 2, further comprising: a cross bore provided at the second end portion of the threaded rod, said handle member being slidably received in the cross bore.

4. The brace assembly according to claim 1, further comprising:

another bar having a first end portion and a second end portion; and a connector for interconnecting the bar and the another bar.

5. The brace assembly according to claim 4, further comprising:

holes formed in each of the bar, the another bar and the connector; and a plurality of locking pins for interconnecting the bar and the another bar to the connector, with each of the plurality of locking pins extending through a respective set of the holes which are aligned.

6. The brace assembly according to claim 1, further comprising:

an extension adapted to slidably receive the second end portion of said bar, wherein the extension redefines the second end portion of the bar so as to be positionable against a respective one of the opposing frame walls.

7. The brace assembly according to claim 6, further comprising:

holes formed in each of the bar and the extension; and a plurality of locking pins for interconnecting the bar and the extension, with each of the plurality of locking pins extending through aligned ones of the holes in the bar and the extension.

8. The brace assembly according to claim 1, further comprising: a gripping pad provided on the second end portion of the bar.

9. The brace assembly according to claim 1, further comprising: a connecting strip for interconnecting multiple windowed building component protecting panels.

10. The bracing assembly according to claim 9, wherein the connecting strip includes spaced walls which are interconnected by a cross piece, with the spaced walls and cross piece defining opposing panel receiving channels.

11. On a building having a windowed building component located between opposing frame walls and a panel extending across the windowed building component in order to protect the windowed building component during a storm, a brace assembly comprising:

a bar having a first end portion and a second end portion which are spaced apart so as to define a longitudinal length of the bar, wherein the bar is formed of wood and includes a bore formed in the first end portion;

a plate fixed at the first end portion of the bar, said plate including a threaded hole; and a threaded rod having a first end and a second end, the first end of the rod being sized to be freely received in the bore, and said first end being adjustably, threadably connected to the bar through the threaded hole and said second end including a foot plate, wherein said brace assembly being positioned against the panel for substantially the entire longitudinal length of the bar and positioned across the windowed building component with rotation of the threaded rod forcing the foot plate and second end portion of the bar against the opposing frame walls, thereby securing the panel in a protective posture across the windowed building component.

12. The brace assembly according to claim 11, wherein the plate is fixed directly to a terminal end of the first end portion of the bar.

13. A method of protecting a windowed building component during a storm comprising:

placing at least one protective panel across the windowed building component within a building opening including opposing frame walls;

positioning a brace assembly between the opposing frame walls with a bar of the brace assembly pressing against the protective panel for substantially an entire longitudinal length of the bar;

initiate longitudinal shifting a rod, which is threadably attached to a plate provided on a first end portion of the bar of the brace assembly, relative to the bar by rotating the rod such that a first end of the rod shifts out of the bar; and continuing to longitudinally shift the rod relative to the bar such that each of a second end portion of the bar and a foot piece provided on a second end of the rod abuts a respective one of the opposing frame walls.

14. The method of claim 13, further comprising: threadably attaching the rod to the first end portion of the bar by fixing a plate having a nut defining threaded hole to the first end portion.

15. The method of claim 13, further comprising: rotating the rod through a handle member attached to the rod.

16. The method of claim 13, further comprising: interconnecting a pair of the bars through a connector and locking pins to form the brace assembly.

17. The method of claim 16, further comprising: attaching an extension onto the second end portion of the bar.

18. The method of claim 17, further comprising: interconnecting the bar and the extension through locking pins to form the brace assembly.

19. The method of claim 13, further comprising: interconnecting multiple protective panels across the windowed building panel through a connecting strip.

20. The method of claim 19, further comprising:

positioning the connecting strip such that an edge of one of the multiple protective panels is received in a channel of the connecting strip; and locating an edge of another one of the multiple protective panels in an opposing channel of the connecting strip.

* * * * *